US007703384B2

(12) United States Patent
Annis et al.

(10) Patent No.: US 7,703,384 B2
(45) Date of Patent: Apr. 27, 2010

(54) HEIGHT-ADJUSTABLE FOOD TRANSFER PLATFORM

(75) Inventors: Jeffrey A. Annis, Boyceville, WI (US); James Hubbard, Menomonie, WI (US)

(73) Assignee: WiSys Technology Foundation, Inc., Madison, WI (US)

( * ) Notice: Subject to any disclaimer, the term of this patent is extended or adjusted under 35 U.S.C. 154(b) by 346 days.

(21) Appl. No.: 11/738,179

(22) Filed: Apr. 20, 2007

(65) Prior Publication Data

US 2007/0186789 A1 Aug. 16, 2007

Related U.S. Application Data

(60) Provisional application No. 60/793,912, filed on Apr. 21, 2006.

(51) Int. Cl.
*A23L 1/00* (2006.01)

(52) U.S. Cl. ..... 99/331; 99/446; 99/448; 99/483; 219/494; 219/497

(58) Field of Classification Search ..... 99/325–333, 99/339, 340, 348, 352–355, 444–450, 403–418, 99/485–489, 483; 126/19 R, 214 R, 268; 312/290; 219/391, 478, 494–497, 400, 401, 219/450.1, 411
See application file for complete search history.

(56) References Cited

U.S. PATENT DOCUMENTS

| | | | | |
|---|---|---|---|---|
| 2,478,254 | A * | 8/1949 | Doner | 312/290 |
| 3,908,749 | A * | 9/1975 | Williams | 165/61 |
| 5,048,857 | A * | 9/1991 | Stevens | 280/651 |
| 2002/0096509 | A1 * | 7/2002 | Von Mosshaim | 219/452.11 |
| 2004/0159268 | A1 | 8/2004 | George et al. | |
| 2009/0007800 | A1 * | 1/2009 | Maroti | 99/421 HV |

OTHER PUBLICATIONS

Web page: bjindustries.com/ELEVATING COOKTOPS. HTM, "Series K-400, Cooktops", printed Aug. 21, 2007.

* cited by examiner

*Primary Examiner*—Timothy F. Simone
(74) *Attorney, Agent, or Firm*—Boyle Fredrickson, S.C.

(57) ABSTRACT

A food transfer platform incorporating a stove unit elevates to different heights, by an extendible column, and can move along a floor.

16 Claims, 2 Drawing Sheets

HEIGHT-ADJUSTABLE FOOD TRANSFER PLATFORM

CROSS-REFERENCE TO RELATED APPLICATIONS

The present application claims the benefit of U.S. Provisional Patent Application Ser. No. 60/793,912 filed on Apr. 21, 2006.

BACKGROUND OF THE INVENTION

Commercial food preparation is, in effect, a manufacturing operation in which a team of skilled workers operates together to produce meals from component ingredients. Such preparation involves several major activity areas centered on appliances such as a stove, an oven, a refrigerator, a sink, and one or more preparation tables where food ingredients may be chopped or peeled or mixed or set for cooling or staging.

Unlike conventional manufacturing operations, much of the work in kitchens is performed manually using equipment and methods that differ only in slight degrees from those used hundreds of years ago. The work preparing food can be difficult, especially in commercial quantities, which may involve moving of large and bulky food containers that may be hot, in an environment where spills and moisture are inevitable. Mixing and cutting large quantities of food can involve repetitive manual activities that may promote repetitive motion injuries.

The variety and range of tasks undertaken in a commercial kitchen nevertheless require great flexibility in the equipment. Space is normally at a premium and specialized equipment that may be appropriate in a manufacturing environment may be commercially impractical in a commercial kitchen operating in a highly competitive environment.

BRIEF SUMMARY OF THE INVENTION

The present invention provides a novel new appliance for use in commercial and other kitchens providing a mobile stove unit including a food transfer platform. Motorized columns allow change in height of the food transfer platform and stove-top, allowing the mobile stove unit to be used for transferring heavy or bulky items in the kitchen environment. The stove unit also allows the appliance to be used as a conventional stove, eliminating the need for space that would be required for two separate devices. In addition to height adjustment, the invention allows conventional mixing or food preparation activities to take place at an appropriate height for a range of individuals so as to reduce repetitive motion injuries.

Specifically, then, the present invention comprises a kitchen appliance having a base with a plurality of downwardly extending wheels, to engage the floor and allow the base to move across a floor and providing a food transfer platform, sized to allow food preparation. The food transfer platform holds least one heating element for cooking, supported by the top of the food transfer platform. The appliance further has an extendible column that has a motor to adjust the height. The column is extendible by using a control panel providing electrical switches to control the motor. The appliance is powered by a power cord having an electrical plug to engage an electrical outlet and provide energy to at least one heating element.

It is thus one aspect of one embodiment of the invention that it provides a stove unit that can be used for preparation and transfer of food items in a kitchen.

In one embodiment of the invention, the column is extendible by more than 12 inches. This allows the cooking and food transfer platform to extend between about 27 inches and about 42 inches.

It is one aspect of one embodiment of the invention to cover the proper working height for up to 90 percent of the population for a variety of cooking tasks. This aspect of the invention allows the food transfer platform to move up and down to accommodate different areas of the kitchen. For example, a user may move the stove over to the refrigerator, adjust the height of the food transfer platform to equal the height of the refrigerator shelf and slide a heavy pot from the refrigerator to the food transfer platform, eliminating the need for picking up the pot and carrying it. The user could then move the appliance to a different area and adjust the food transfer platform to a height suitable for that particular user's needs.

In one embodiment, the heating element is an electrical resistance heater. This allows an electrical heating element to evenly distribute heat for cooking, sautéing, or keeping food warm.

It is one aspect of one embodiment of the invention to provide a simple and familiar stove unit.

In one embodiment, the heating element is alternatively an induction heater. An induction heater only warms the pot or pan on the heater, but when an induction heater is turned off, the heating element is immediately cool to the touch.

It is one aspect of one embodiment of the invention to allow the appliance to easily transfer from cooking use to food preparation use.

The invention may further include a set of upwardly extending glide rails affixed to the top of the food transfer platform.

It is one aspect of one embodiment of the invention to facilitate the transfer of heavy pots and the like to allow easy motion in a parallel direction to the rails, but difficulty to slide objects in a perpendicular direction to the rails. The guide rails may corral pots and pans when the user is moving the height-adjustable appliance from one area to another.

The appliance may further include at least one sensor that perceives an adjacent surface and communicates with the control panel and motor to adjust the height of the food transfer platform to a height of an adjacent surface.

Thus it is another aspect of at least one embodiment of the invention to automatically adjust to the height of an adjacent surface. Such a feature allows a user to be able to slide a heavy stockpot from a standard counter to the invention's food transfer platform, without needing to pick up the pot and risk injury.

More particularly, the appliance may include a sensor that may read particular encoded signals from infrared transmitters on adjacent work surfaces to automatically change the height to be compatible with those work surfaces.

The appliance may further include, on the periphery of the food transfer platform, along its vertical surface, pressure-sensitive switches and/or sensors, such as infrared or ultrasonic sensors that may sense the proximity or contact of the edge of the food transfer platform and other surfaces.

It is thus another aspect of one embodiment of the invention to reduce the possibility of finger pinching when the food transfer platform is raised or lowered.

The invention may further include at least one brake affixed to the wheels.

It is an aspect of one embodiment to allow a user to secure the height-adjustable appliance in place during cooking or food preparation.

The brake may be electromechanical and may communicate with the control panel, such that the brake locks in place if the heating element is in use.

It is therefore another aspect of at least one embodiment of the invention to prevent moving the appliance while it is being used to cook food.

The electromechanical brake may communicate with the power cord such that the brake locks in place when the power cord is engaged with an electrical outlet.

It is thus another aspect of an embodiment of the invention to prevent a user from inadvertently attempting to move the height-adjustable appliance when it is still plugged into an electrical outlet.

The appliance may include a battery, wherein the battery powers the motor that elevates the food transfer platform. One aspect of one embodiment allows a user to use the height-adjustable appliance as a food transfer platform alone. The user can move the food transfer platform vertically, using only battery power. Therefore, such a user need not be near an electrical outlet when using the height-adjustable appliance for food preparation only or adjusting to surfaces after moving.

The battery may be capable of recharging when the power cord is engaged with an electrical outlet. One aspect of one embodiment allows the food transfer platform to be moved vertically even when the appliance's power cord is not plugged into an electrical outlet. This allows the appliance to be used as an extra food preparation area, with the ability to provide proper height for up to 90 percent of the population.

A waste receptacle may be affixed to the food transfer platform. In one embodiment, there is an opening in the food transfer platform surface, with a waste receptacle underneath. Another embodiment may include an inset bin that may slide in underneath an aperture in the food transfer platform, for receiving waste during food preparation. One aspect of at least one embodiment allows the user to immediately discard excess or inedible parts of food during food preparation and cooking.

The appliance may also include a pull-out storage in the form of drawers in the food transfer platform. One aspect of one embodiment allows pots, pans, or utensils to be stored conveniently with the appliance. More particularly, plastic food preparation items, such as bowls or utensils, could be stored with the appliance, unlike with conventional electric ranges.

The appliance may have an adjustment mechanism between the column and the food transfer platform to allow the food transfer platform to be leveled or tilted.

The appliance may include a charger for charging the battery when the unit is stationary or not in use through the use of a separate low amperage charging cord. The motor controller may further provide a power converter to provide a necessary conversion of voltage between the battery, for example, a sealed lead acid battery, and the motor units.

The base may further include an upper cowling at each end and an upper cover that are upwardly convex to prevent items from being rested or stacked on the upper cowling or cover or balanced thereon.

The invention may further include a frame that supports and surrounds a downwardly extending tray which provides a bottom that is substantially below the frame allowing the extendible columns to descend to a point allowing the food transfer platform and heating element height to be as low as 27 inches and to extend as high as 42 inches. The bottom of the tray, as well as a battery and other circuitry provide the base.

One aspect of at least one embodiment of the invention is that the height-adjustable appliance has an extremely low center of gravity and an extremely low mounting point for the extendable columns.

It is specifically intended that the present invention not be limited to the embodiments and illustrations contained herein, but that modified forms of those embodiments including portions of the embodiments and combinations of elements of different embodiments also be included as coming within the scope of the following claims.

Various other features, objects and advantages of the invention will be made apparent from the following description taken together with the drawings. These particular features and advantages may apply to only some embodiments falling within the claims and thus do not define the scope of the invention.

DETAILED DESCRIPTION OF THE INVENTION

Figure 1:
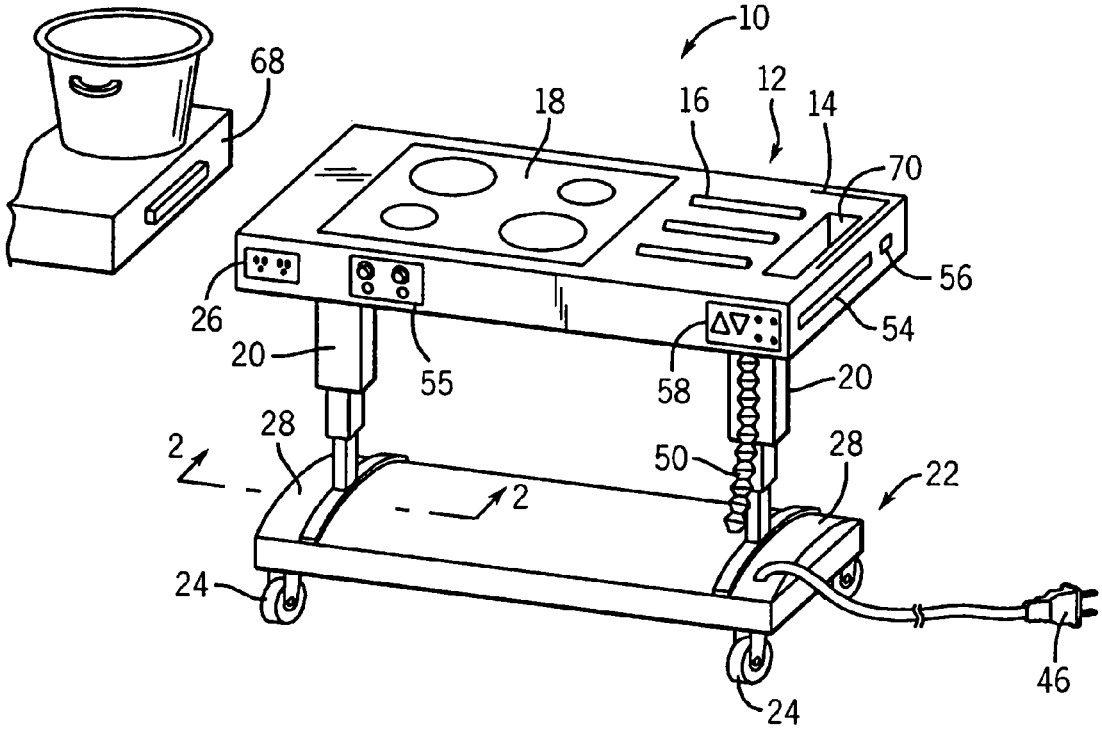
FIG. 1 is a perspective view of a height-adjustable appliance such as may incorporate the present invention.

Referring now to FIG. 1, a height-adjustable appliance 10 of the present invention may include a generally horizontal and planar food transfer platform 12, such as may be used for food preparation or as a cooking surface.

Preferably, the food transfer platform 12 is formed of a stainless steel sheet, for example a 16 gauge stainless steel sheet, and may have an upper area as much as thirty inches by sixty inches. The edges of food transfer platform 14 may be raised to provide a drip edge containing spilled liquids and upwardly extending glide rails 16 may be embossed in the food transfer platform 12, providing upward ridges whose crests support the bottoms of pans or the like (not shown) to limit contact between the food transfer platform 12 and the pans reducing sliding friction, heat transfer, and contact with spilled liquids.

A heating element 18, for example an induction heating unit, may be installed in the food transfer platform 12, allowing for cooking of foods. The induction heating unit reduces the incidental heating of the food transfer platform and eliminates flame such as may ignite oils or the like. Alternatively element 18 may be a standard resistance type heating element.

Opposed ends of the food transfer platform 12 are supported by two corresponding extendible columns 20 whose upper ends attach to an underside of the food transfer platform 12 and whose lower ends are supported on a base 22.

The base 22 provides a rectangular platform roughly the size of the food transfer platform 12 and may include wheels 24 in each corner to allow the base 22 to roll over a smooth floor 34 or the like. The base 22 includes an upper cowling 28 covering the upper surfaces of the base 22 which is upwardly convex to prevent items from being rested or stacked on the base 22 or balanced thereon.

Figure 2:
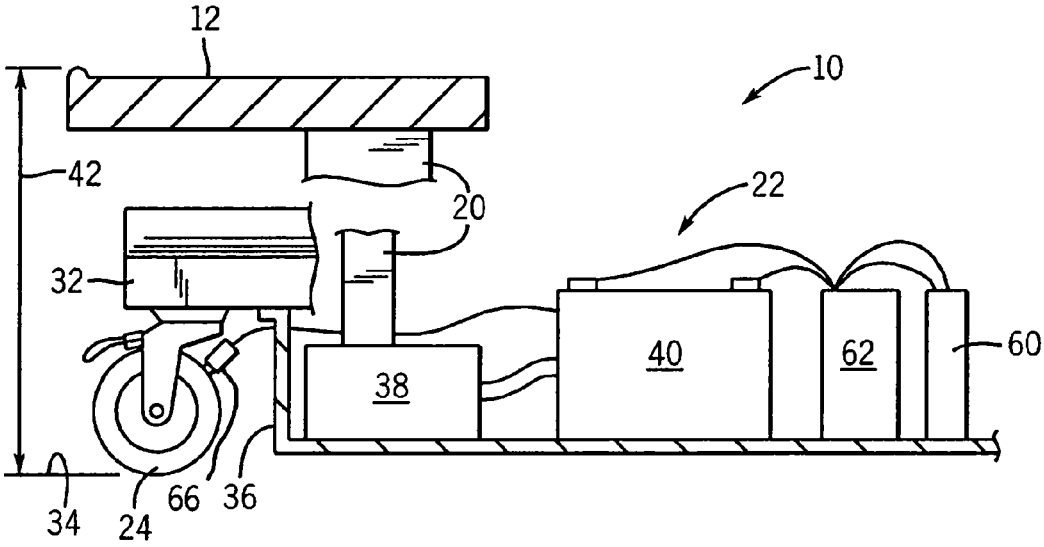
FIG. 2 is a fragmentary partial cross-section of the height-adjustable appliance.

Referring now also to FIG. 2, the base 22 may have a frame 32 being in a preferred embodiment a rectangular frame of square tube steel elevated sufficiently above the floor to receive on its underside the wheels 24, which may be of food grade quality and which may provide foot actuated or electrically activated brakes 66, and offset swivels as is understood in the art allowing the wheels 24 to rotate to align with the direction in which the base 22 is pushed.

The frame 32 supports and surrounds a downwardly extending tray 36 which provides a bottom supporting the bottom of the columns 20 that is substantially below the frame allowing the food transfer platform 12 and heating element 18 height to be as low as about 27 inches and to extend as high as about 42 inches. The bottom of the tray 36 also supports the batteries 40 and other circuitry as will be described providing the base 22 and thus the height-adjustable appliance with an extremely low center of gravity.

Figure 3:
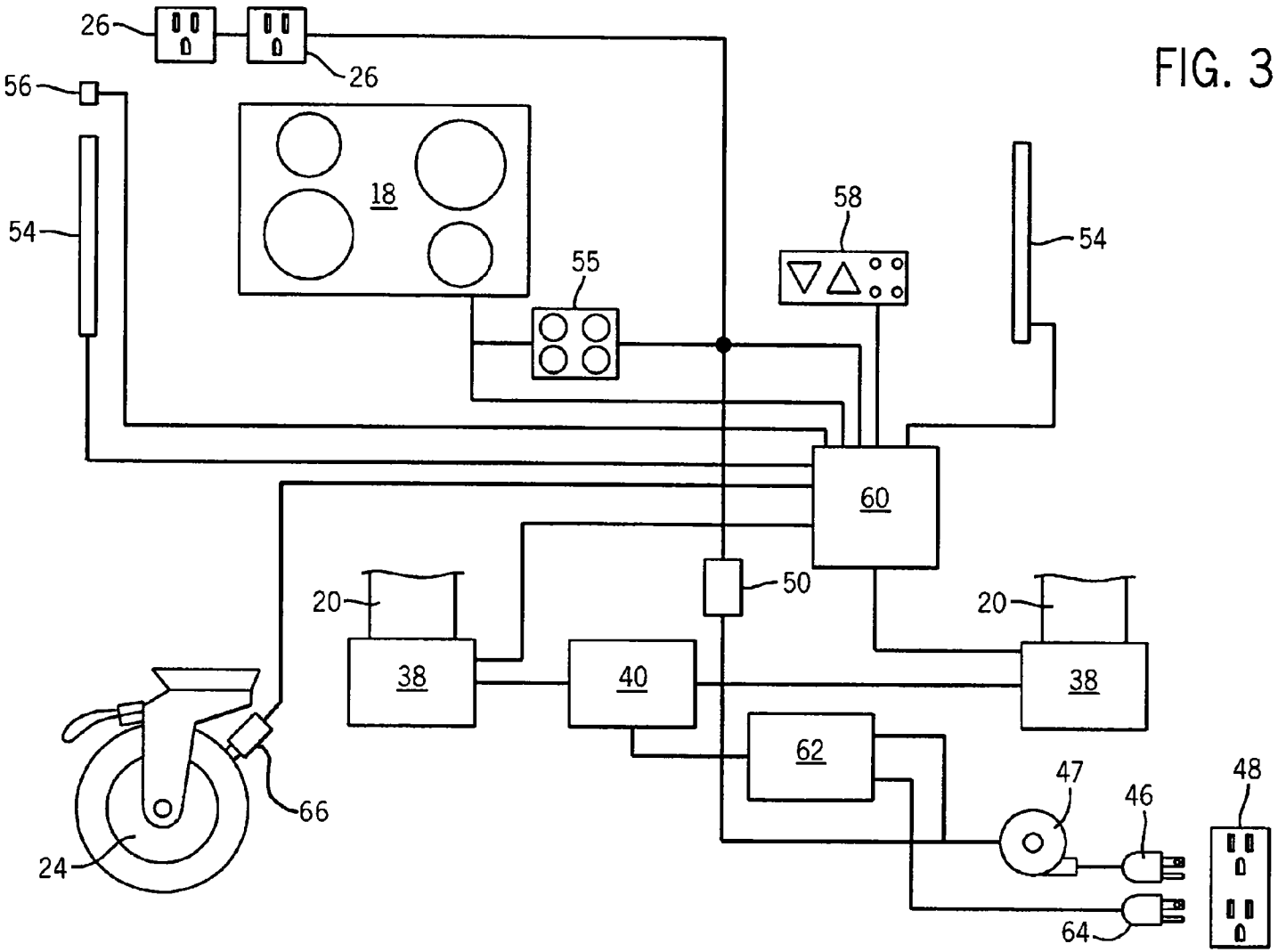
FIG. 3 is a schematic block diagram of the electrical connections of the height-adjustable appliance.

Referring to FIGS. 1 and 3, the heating element 18 may receive power from a retractable power cord 46 such as may be optionally provided with a spring-loaded retractor 47. The cord 46 may extend from the base 22 to be plugged into a stationary outlet 48 when the height-adjustable appliance is positioned for cooking. Conductors of the cord 46 may pass through an elastomerically extensible tube 50, such as a molded bellow, joining the base 22 and the food transfer platform 12 to restrain and guide the conductors. Alternatively or in addition, the conductors (not shown) extending between the base 22 and the food transfer platform 12, may be coiled as with a telephone cable to reduce the chance of the conductors kinking or breaking throughout a range of extensions corresponding to different heights of the food transfer platform 12.

At the food transfer platform 12, power from the cord 46 may also be routed to two ground fault circuit interrupter (GFCI) outlets 26 that may be positioned on edges of the food transfer platform 12.

The power from the cord 46 may also be routed to a controller 60 that may monitor the power, for example, to operate the electromagnetic brake or to provide a warning signal.

The periphery of the food transfer platform 12 along its vertical surface may include pressure-sensitive switches 54 and/or sensors 56, such as infrared or ultrasonic sensors that may sense the proximity or contact of the edge of the food transfer platform 12 and other surfaces 68 to reduce the possibility of finger pinching when the food transfer platform 12 is raised or lowered. These switches 54 and sensors 56 may also communicate with controller 60. Further, the sensors 56 may allow for automatic height adjustment when the food transfer platform 12 is moved between surfaces of different heights, for example, in the transfer of materials from one surface to another, aligning the top of the food transfer platform 12 with the adjacent surface to aid in the loading and unloading of materials. The sensors 56 may read particular encoded signals from infrared transmitters on adjacent work surfaces to signal the controller 60 to automatically change the height to be compatible with those work surfaces.

A control panel 58 may also be placed conveniently on an edge of the food transfer platform 12 to allow for control of the elevation through simple button presses communicated to the controller 60. The control panel 58 may employ membrane switches 54 that may be easily cleaned. Similar standard controls 55 may be used for the induction or resistance heating elements 18.

Referring still to FIG. 3, the motor controller 60 receives power from the battery 40 at a low voltage, for example, twelve volts, to provide power to motor units 38 controlling the extension or telescoping of the columns 20. The motor units 38 may include height feedback signals through encoders or limit switches allowing the motor controller 60 to provide infinitely variable height adjustment from 27 inches to 42 inches as well as up to four pre-programmed height settings that may be accessed through preset buttons on the control panel 58.

A charger 62 may be provided for charging the battery 40 when the unit is stationary through the use of a separate low amperage charging cord 64. Alternatively, and, in addition, the charger 62 may connect to the cord 46 to provide charging when the cord 46 is plugged in.

An inset bin 70 may slide in underneath an aperture in the food transfer platform 12, for example, for receiving waste during food preparation. Pull-out storage may be provided in the form of drawers in the food transfer platform (not shown). Adjustments may be provided between the columns 20 and the food transfer platform 12 to allow the food transfer platform 12 to be leveled or tilted.

An electromechanical brake 66 may be adjacent to the wheels 24. The brake 66 may connect to the controller 60 to provide energy to engage the brake 66 when the power cord 46 is connected to an electrical outlet 48. The controller 60 may also connect to the control 55 so that the brake 66 is engaged when the heating element 18 is energized.

Various alternatives and embodiments are contemplated as being within the scope of the following claims particularly pointing out and distinctly claiming the subject matter regarded as the invention.

The present invention has been described in terms of the preferred embodiment, and it is recognized that equivalents, alternatives, and modifications, aside from those expressly stated, are possible and within the scope of the appending claims.

We claim:

1. A kitchen appliance comprising:

a base with a plurality of downwardly extending wheels, to engage a floor and allow the base to move across a floor as supported by the wheels;

a food transfer platform positioned above the base with respect to the floor and providing a generally horizontal and planar uppermost surface of the kitchen appliance, the uppermost surface free of lateral obstructions that would block a horizontal sliding transfer of materials onto the food transfer platform from sides of the food transfer platform, wherein the food transfer platform has a top and a bottom;

at least one heating element supported by the top of the food transfer platform and upwardly exposed to receive cooking pans to heat the same;

at least one extendible column that is affixed on one end to the food transfer platform and on the other end to the base to extend substantially vertically therebetween so that change in length of the extendible column changes the height of the planar uppermost surface of the food transfer platform above the floor on which the base is supported;

a motor in mechanical communication with the extendible column to change the length of the extendible column with operation of the motor;

a control panel in electrical communication with the motor, the control panel including electrical switches to control the motor to change the length of the extendible column so that a height of the heating element with respect to the floor may be varied by a user operating the control panel; and a power cord connected to the at least one heating element and having an electrical plug to releasably engage an electrical outlet and provide energy to the at least one heating element.

2. A kitchen appliance according to claim 1, wherein the column provides a variable extension having a range of at least 27 inches to 47 inches from the floor.

3. A kitchen appliance according to claim 1, wherein the heating element is an electrical resistance heater.

4. A kitchen appliance according to claim 1, wherein the heating element is an induction heater.

5. A kitchen appliance according to claim 1, wherein the motor is selected from the group consisting of a pneumatic motor and a hydraulic motor.

6. A kitchen appliance according to claim 1, further including an interlock communicating mechanism between the motor and heating element such that the motor cannot power the column when the heating element is energized.

7. A kitchen appliance according to claim 1, further including a set of upwardly extending glide rails affixed to the top of the food transfer platform.

8. A kitchen appliance according to claim 1, further including at least one sensor that perceives an adjacent surface and communicates with the control panel and motor and the adjacent surface to adjust the height of the food transfer platform to a height of an adjacent surface.

9. A kitchen appliance according to claim 1, further including at least one brake affixed to the wheels.

10. A kitchen appliance according to claim 9, wherein the brake is engaged with the control panel, such that the brake locks in place if the heating element is in use.

11. A kitchen appliance according to claim 9, wherein the brake is engaged with the power cord such that the brake locks in place when the power cord is engaged with an electrical outlet.

12. A kitchen appliance according to claim 1, wherein the power cord is attached to a retracting mechanism.

13. A kitchen appliance according to claim 1 further including a waste receptacle that is adjacent to the food transfer platform.

14. A kitchen appliance according to claim 1, further including a battery, wherein the battery powers the motor.

15. A kitchen appliance according to claim 14, wherein the battery is recharged when the power cord is engaged with an electrical outlet.

16. A kitchen appliance according to claim 1, wherein the base includes an upper cowling at each end and an upper cover that are upwardly convex to prevent items from being rested or stacked on the upper cowling.

* * * * *